United States Patent [19]

McCarty et al.

[11] 4,346,566

[45] Aug. 31, 1982

[54] REFRIGERATION SYSTEM GRAVITY DEFROST

[75] Inventors: William J. McCarty; Walter J. Pohl; Russell L. McCreary, all of Louisville, Ky.

[73] Assignee: General Electric Company, Louisville, Ky.

[21] Appl. No.: 270,296

[22] Filed: Jun. 4, 1981

[51] Int. Cl.[3] ..... F25B 29/00; F25B 47/00

[52] U.S. Cl. ..... 62/159; 62/196 R; 62/197; 62/275; 62/278

[58] Field of Search ..... 62/196 C, 196 R, 81, 62/277, 278, 159, 160, 324.6, 324.5, 275, 197, 151

[56] References Cited

U.S. PATENT DOCUMENTS

| | | | |
|---|---|---|---|
| 2,039,089 | 4/1936 | Koch | 62/196 C |
| 2,175,913 | 10/1939 | Philipp | 62/196 C |
| 2,878,657 | 3/1959 | Atchison | 62/325 |
| 3,159,981 | 12/1964 | Huskey | 62/156 |
| 3,370,437 | 2/1968 | Jacobs | 62/160 |
| 3,511,060 | 5/1970 | Bodcher | 62/140 |
| 3,555,842 | 1/1971 | Bodcher | 62/140 |
| 3,871,187 | 3/1975 | Skvarenina | 62/196 |
| 4,027,497 | 6/1977 | Thurman | 62/156 |
| 4,158,950 | 6/1979 | McCarty | 62/81 |
| 4,285,210 | 8/1981 | McCarty | 62/160 |

FOREIGN PATENT DOCUMENTS

| | | | |
|---|---|---|---|
| 52-9146 | 1/1977 | Japan | 62/81 |

*Primary Examiner*—Albert J. Makay
*Assistant Examiner*—Harry Tanner
*Attorney, Agent, or Firm*—Frank P. Giacalone; Radford M. Reams

[57] ABSTRACT

A reverse air cycle type heat pump is provided that utilizes a refrigeration system having a unidirection refrigerant flow wherein the condenser and evaporator retain their functions, but the air directed across them is redirected for different operations. The refrigeration system is provided with a secondary defrost circuit including a first conduit between the upper portion of the evaporator and the compressor casing and a second conduit having a valve which permits refrigerant flow to by-pass the expansion device only when compresssor operation terminates and the system pressure differential is equalized. This defrost circuit causes the relatively warm refrigerant in gaseous phase in the compressor to displace the relatively cold refrigerant in liquid phase in the evaporator with the flow continuing until the defrost process is completed.

6 Claims, 2 Drawing Figures

111
112
122
116
114
L1
C
C
H
H
120
124
118
FROST
SENSOR
134
132
136
138
141
142
146
148
126
144
150
130
COND.
FAN
56
140
152
52
54
COMP.
EVAP.
FAN
L2

REFRIGERATION SYSTEM GRAVITY DEFROST

BACKGROUND OF THE INVENTION

The reverse air cycle type of heat pump utilizes unidirection refrigerant flow wherein the condenser and evaporator retain their functions, but the air directed across them is redirected for different operations. While the heat pump is operating in the cooling mode, outdoor air is passed in heat exchange relationship with the condenser for liquifying the refrigerant and outside again; and indoor air is passed in heat exchange relationship with the evaporator for cooling the air and circulated again. Conversely, in the heating mode, outdoor air passes in heat exchange relationship with the evaporator for vaporizing the refrigerant, then outside again; and indoor air is passed in heat exchange relationship with the condenser for heating the air and circulated again.

One prior art U.S. Pat. No. 2,878,657—Atchison, assigned to General Electric Company, the assignee of the present invention, discloses a heat pump wherein the air conditioning unit includes a plurality of air controlling valves, each of which is associated with an opposed inlet and outlet opening of the unit. The valves permit selective control of the air flowing into and discharging from the unit in order to direct air either from the outside or from within the enclosure over either of the heat exchangers disposed within separate compartments of the unit.

Under certain operating conditions in the heating cycle, the evaporator may operate at such low outdoor ambient temperatures as to cause the accumulation of a coating or layer of frost on its surface. Since frost when it accumulates operates as a barrier to heat transfer between the evaporator and the air being circulated thereover, the efficiency of the unit is markedly reduced. Further, unless means are provided for interrupting the accumulation of frost, the evaporator can become completely filled with a layer of frost that may effectively block air passage therethrough. This blockage of air results in the loss of heat exchange and if allowed to continue can cause the refrigeration system components to fail and can also result in compressor burn-out unless compressor operation is terminated.

In U.S. Pat. No. 3,555,842-Bodcher, a defrost line connects the upper inlet of the condenser to the upper inlet of the evaporator and includes a defrost valve which is closed during operation of the compressor but opens when compressor operation terminates. A return line connects the evaporator collector with the lower part of the condenser and includes a valve which operates in the same manner as the defrost valve.

In U.S. Pat. No. 4,158,950-McCarty, assigned to the General Electric Company, assignee of the present invention, there is disclosed a defrost arrangement for refrigeration system of the reverse air cycle. A secondary defrost circuit is provided which permits refrigerant flow to bypass the compressor when compressor operation terminates.

In patent application Ser. No. 144,796-McCarty, filed Apr. 28, 1980, U.S. Pat. No. 4,285,210, assigned to the General Electric Company, assignee of the present invention, there is described a defrost arrangement for a refrigeration system employed in a reverse air cycle heat pump of the type employed in the present invention.

SUMMARY OF THE INVENTION

An object of the present invention is to provide a refrigeration gravity defrost system for a reverse air cycle type heat pump that effectively and quickly removes frost from the evaporator surface during the heating cycle.

Another object of this invention is to provide means in the gravity defrost system that insures that the temperature of the gravity circulating refrigerant is maintained at a temperature that assures rigorous gravity cycling of the refrigerant when the refrigeration system compressor operation terminates.

The present invention provides a gravity defrost arrangement in a refrigeration system of the type having a refrigerant capable of boiling under relatively low pressure to absorb heat and condensing under relatively high pressure to expel heat. The refrigeration system includes a hermetic casing housing a compressor for compressing a refrigerant fluid in gaseous phase, condenser having its inlet connected to the compressor outlet and its outlet connected to the evaporator inlet through the liquid conduit, with the outlet of the evaporator connected to the compressor inlet through a suction conduit. Refrigerant flow is regulated between the condenser and evaporator by a flow control means in the liquid conduit.

The defrost means includes a first defrost flow passage connected in parallel with the liquid line and a second defrost flow passage connected between the condenser and evaporator through the compressor casing. Valves are provided in the first and second defrost flow passages which are operable to a closed position when a refrigerant pressure differential is present in the system and to an open position when the pressure differential is bled down through the flow control means after compressor operation terminates. This arrangement of valves and defrost flow passages provides a nonrestrictive refrigerant defrost flow path circuit which bypasses the flow control means through the first defrost flow passage between the condenser and evaporator and a second defrost flow passage between the condenser and evaporator through the compressor casing. Accordingly liquid refrigerant when present in the lower portions of the evaporator flows through the first defrost flow passage into the lower portion of the condenser, while the warmer gaseous refrigerant in the condenser will flow through the second defrost flow passage from the condenser through the compressor casing into the upper portion of the evaporator to raise the temperature of the evaporator and melt frost when present. Control means are provided including heat means for raising the temperature of refrigerant in the compressor casing to a predetermined valve to insure the flow of refrigerant through the compressor casing between the condenser and the evaporator independent of ambient temperature conditions.

DESCRIPTION OF THE PREFERRED EMBODIMENT

Figure 1:
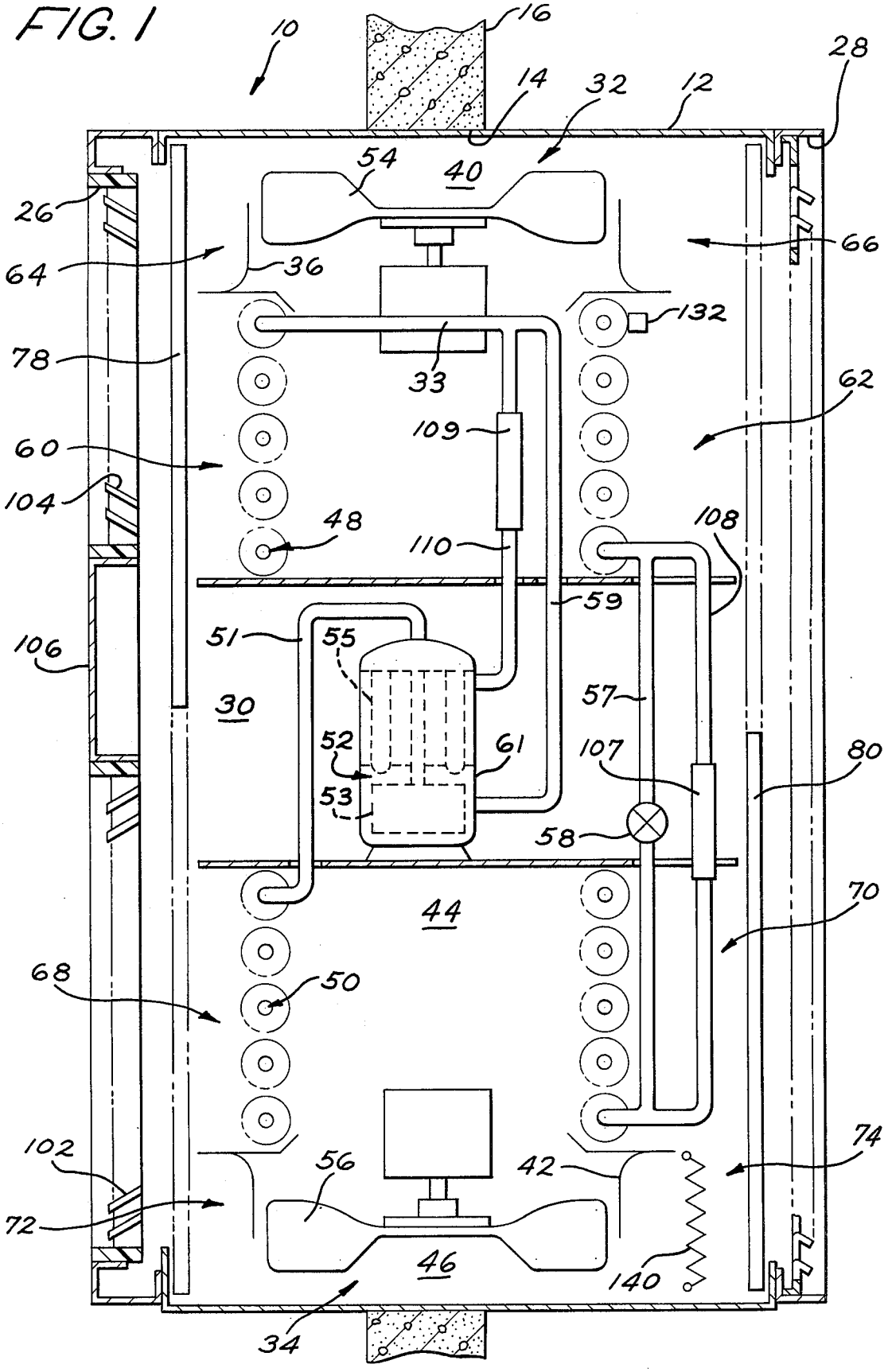
FIG. 1 is a side elevational view of an air conditioning unit showing a schematic of the refrigeration system incorporating the present invention.

Referring now to the drawing, there is shown an air conditioning unit 10 of the reverse air cycle type fully disclosed in patent application Ser. No. 144,796 McCarty, filed Apr. 28, 1980, assigned to the General Electric Company and said application is hereby incorporated by reference.

Air conditioning unit 10 includes a housing 12 that is adapted to be arranged in an opening 14 in the wall 16 of an enclosure to be conditioned. The housing walls define generally a front opening 26 disposed on the enclosure side of wall 16 and a rear opening 28 disposed in the outdoor side of the wall 16. The housing is divided by a central machine chamber 30 to include an upper evaporator compartment 32 and a lower condenser compartment 34. A fan shroud 36 substantially divides the evaporator compartment 32 into an inlet area 38 and an outlet area 40. A fan shroud 42 substantially divides the condenser compartment 34 into an inlet area 44 and an outlet area 46. Mounted in the housing 12 is an evaporator 48 arranged in the inlet area 38 of compartment 32, a condenser 50 arranged in the inlet area 44 of compartment 34, and the compressor 52 arranged in the chamber 30. Air is circulated by a fan 54 in shroud 36 from the evaporator inlet area 38 to the outlet area 40 and similarly air is circulated by a fan 56 in shroud 42 from the condenser inlet area 44 to outlet area 46. The compressor 52 includes a hermetic casing 61 in which is mounted the compressor 53 driven by an electric motor 55.

In the sealed closed circuit refrigeration system, the compressor discharge or outlet is connected by a discharge line 51 to the condenser inlet which is arranged in the upper portion of the condenser. The liquid line 57 including the flow control or expansion device 58 is connected between the outlet of the condenser which is arranged at the lower end thereof and the inlet of the evaporator which is arranged at the lower end thereof. The suction line 59 is connected between the compressor and the evaporator outlet which is arranged at the upper end thereof.

The air flow inlet and outlet areas of the evaporator and condenser compartments are arranged in the housing 12 with each area having a pair of openings therein, one communicating with the opening 28 facing the outdoor, and a second opening communicating with the opening 26 facing the enclosure whereby air can be both introduced and discharged from the evaporator and condenser compartments in two different directions. More specifically, the evaporator inlet area 38 contains openings 60 and 62 and the outlet area 40 contains openings 64 and 66 in the indoor and outdoor side respectively of housing 12. Similarly, condenser compartment inlet area 44 is provided with openings 68 and 70 and the outlet area 46 is provided with openings 72 and 74 in the indoor and outdoor side respectively of housing 12.

A pair of dampers or air valves 78 and 80 are provided for controlling air flow through the compartments 32 and 34 which are arranged for vertical movement in openings 26 and 28 respectively. The dampers 78 and 80 are interconnected by suitable cables (not shown) to insure proper location of one damper over a compartment inlet and outlet on one side of the housing by movement of the damper arranged on the other side of the housing. The cable system interconnecting the indoor and outdoor dampers is fully explained in the above mentioned application Ser. No. 144,796.

In the heating mode, the dampers 78 and 80 are arranged in the position shown wherein air flow through the condenser chamber 34 is used to heat the air circulated from the enclosure. That is in the heating mode, the damper 78 closes the evaporator compartment inlet opening 60 and outlet opening 64 on the enclosure side opening 26 of housing 12 so that outdoor air is circulated through evaporator compartment 32 and, the damper 80 closes the condenser compartment inlet opening 28 of housing 12 so that enclosure air is circulated through the condenser compartment 34 to warm the enclosure air recirculating therethrough. In the cooling mode, the indoor damper 78 would be positioned over the enclosure side condenser inlet 68 and outlet 72 area opening, and the outdoor damper 80 would be positioned over the outdoor side evaporator inlet 62 and outlet 66 area opening so that outdoor air is circulated through the condenser chamber 34 and enclosure air is circulated through the evaporator chamber 40 to cool the enclosure air.

Arranged over the front or indoor opening 26 of housing 12 is a front grille or appearance member 100 that includes a louvered portion 104 positioned over inlet 60 and outlet 64 of evaporator chamber 32 and a louvered portion 102 positioned over the inlet 68 and outlet 72 of the condenser chamber. A central control panel 106 housing the appropriate controls for the air conditioner is located between louvers 102 and 104 and generally positioned in the area of chamber 30 between the compartments 32 and 34.

In the course of this unit operating in the heating mode, water vapor under certain ambient conditions condenses on the evaporator through which as explained hereinbefore outdoor air passes. In some instances, the amount of water vapor available in the outdoor ambient is great enough to solidify and form a layer of frost or ice which blocks air flow through the heat exchanger. This layer of frost or ice must be removed when it has a thickness which opposes the desirable transfer of heat from the heat exchanger. Accordingly, by the present invention, means are provided that permit defrosting and elimination of frost or ice when present in the evaporator each time operation of the system compressor terminates. In its preferred application, the present embodiment of the defrost system is intended to be used in defrosting the evaporator in a manner that will not completely interrupt the heating process of the enclosure air.

The means for effecting the defrosting of the evaporator as shown in the drawing includes a by-pass line or conduit 108 which is connected between the lower portions of evaporator 48 and condenser 50. In effect, the by-pass 108 is arranged in parallel flow relationship with the system expansion device 58 in the system liquid line 57. A defrost line or conduit 110 is connected between the upper portion of the evaporator 48 or adjacent suction line 59 and the upper portion of the compressor casing. In effect, a circuit provided through line 110 will draw refrigerant in gaseous state from the upper portion of the condenser through the line 51, compressor casing 61 and direct it into the upper portion of the evaporator in a manner to be explained later. The defrost circuit provided by the present invention is through a closed loop provided by conduits 108, 110 and heat exchangers 48 and 50 with refrigerant gas flowing through the compressor. The liquid line 57 and the expansion device 58 being bypassed. Means are provided to prevent refrigerant flow through either conduit 108 or 110 when the compressor 52 is circulating refrigerant during normal operation of the refrigerating system. To this end, valves 107 and 109 are provided respectively in the conduits 108 and 110.

The valves 107 and 109 are designed to close when a pressure differential is present in the system. Since this pressure differential is created by compressor operation, valves 107 and 109 will remain closed when the system is operating. Accordingly, the added by-pass conduits 108 and 110 and their respective valves 107 and 109 have no effect on the system during its normal operation. Further, the valves are designed to remain closed until after the compressor operation terminates and the system pressure differential created by the operating compressor is fed or bled down through the normal system expansion device 58. At this point, the valves 107 and 109 will open and the by-pass defrost circuit mentioned above is established.

In operation with the unit in the heating mode and a frost condition sensed by a frost sensor 132 on the evaporator 48 compressor operation will terminate. At this time, as mentioned above, with the compressor 52 not operating, the system pressure differential will bleed down through the system expansion device 58. Accordingly, the valves 107 and 109 being no longer under the influence of the pumped refrigerant flow will move to a neutral or open position and a non-restricted defrost flow path between the lower portions of the heat exchangers is established through line 108 and between the upper portion of the heat exchangers through the discharge line 51 compressor casing 61 and by-pass conduit 110. The gaseous refrigerant from the upper portion of the condenser entering the compressor casing 61 through line 51 is heated by the compressor components which are at relatively warm operating temperature. Hot gaseous phase refrigerant at approximately 70° F. will flow from the upper portion of the condenser into the compressor casing 61 and therefrom through conduit 110 and into the upper portion of the frosted evaporator 48. The liquid refrigerant in the lower portion of the evaporator 48, which is relatively cool, flows through line 108 into the lower portion of the warmer condenser 50 where it is heated and returns to gaseous phase.

The liquid refrigerant accumulated in the frosted evaporator 48 will drain into the condenser 50 containing gas due to a gravity head created by the accumulated liquid height and the location of the evaporator above the condenser. The cold liquid at approximately 32° F. from the evaporator will absorb heat from the warm condenser and will change to gas. As liquid drains from the bottom of the evaporator, warm gas will enter the top through conduit 110. This flow of cold liquid out of the bottom of evaporator through conduit 108 to the warmer condenser and the flow of warm gas out of the top of the condenser into the warm compressor casing and through conduit 110 to the upper portion of the cold evaporator produces an effective defrosting cycle that will continue until the temperature of the evaporator approaches the temperature of the condenser and compressor casing. At this point, gravity flow will terminate because liquid can accumulate in both heat exchangers.

In summary, some heat is added to the refrigerant during the defrosting from the warm condenser which is in a relatively warm indoor ambient in the heating mode and from the compressor components in the casing 61. To insure that the temperature of the refrigerant in the condenser returns to gaseous state, an auxiliary heater 140 together with fan 56 can be employed to provide warm air flow through the condenser.

In some adverse outdoor ambient conditions such as windy, extremely low temperature outdoor ambient conditions gravity defrosting may take longer than desirable even when the hot gaseous refrigerant maintained at a normal temperature of 70° F. in the manner described above. Accordingly, by the present invention, to insure that the temperature of the refrigerant migrating to the upper portion of the evaporator is at a temperature sufficient to provide defrosting under substantially all ambient outdoor conditions, means are provided to increase the temperature of the hot gaseous refrigerant in the compressor casing 61 to approximately 150° F.

Heat added to the refrigerant during the defrosting comes from the compressor motor 55 which by the present invention is heated to insure that relatively warm refrigerant gas is supplied through conduit 110 to the evaporator during the defrost mode.

A continuous supply of gaseous refrigerant of approximately 150° F. is obtained by applying heat to the refrigerant in the compressor casing 61 by passing a current through motor 55 in a stalled mode. It should be noted that while it is important that the refrigerant be heated to a temperature that will provide defrosting under substantially all ambient outdoor conditions, heat may be supplied to the refrigerant in the casing in any number of ways, for example, a resistance heater may be applied to the casing either externally or internally in the manner similar to those used to prevent liquid slugging in the compressor. In the present embodiment, the gaseous refrigerant in the compressor casing is maintained at the selected temperature by passing current through the compressor motor in a stalled mode.

Figure 2:
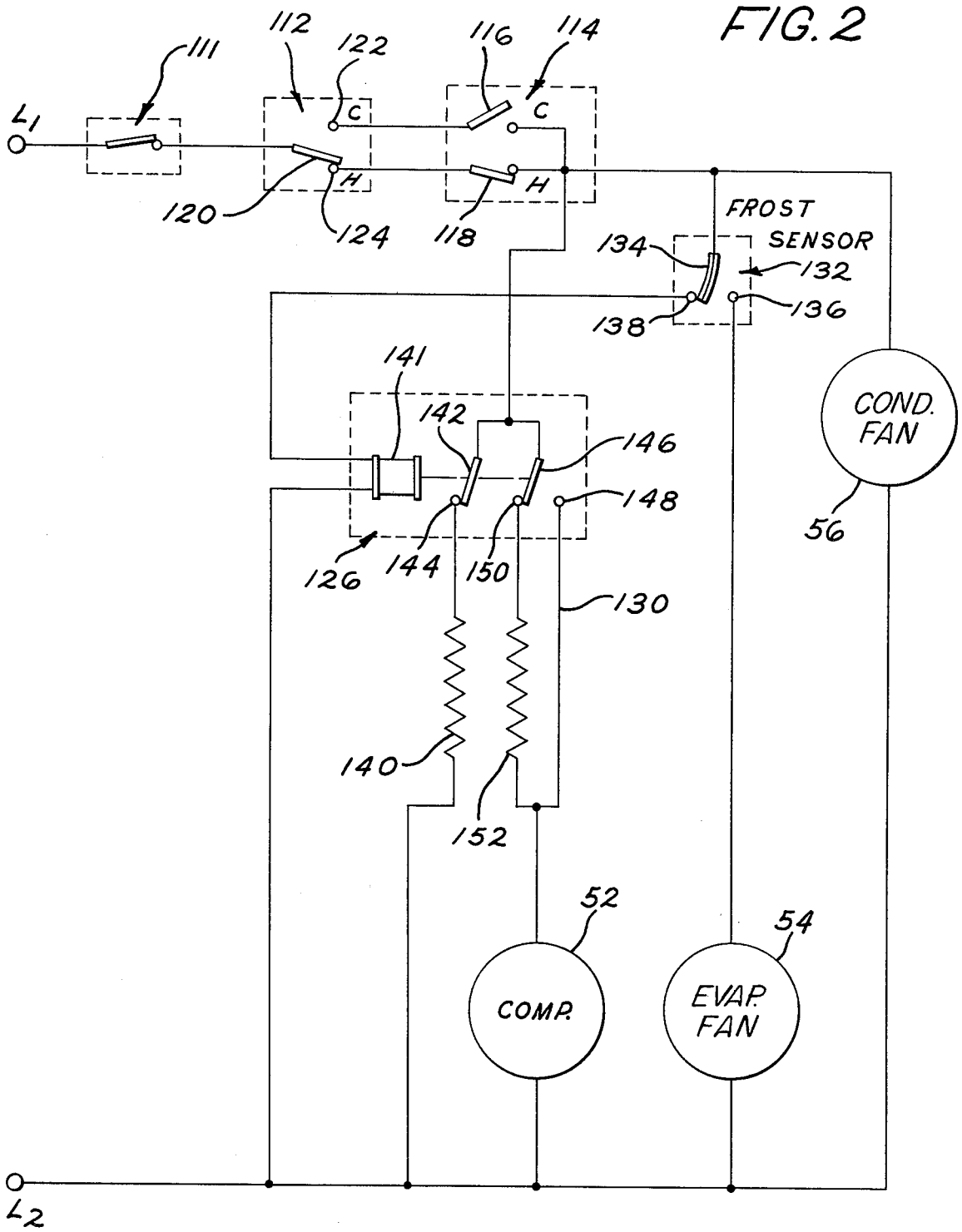
FIG. 2 is a schematic of the control circuit employed in carrying out the present invention.

Referring now to FIG. 2, there is shown a control circuit for the air conditioning unit which includes means for providing heat to the compressor casing when the system is in a defrost mode. The present circuit is merely representative of a control means for carrying out the present invention and any number of circuits or components may be utilized to provide heat to the casing. For a more complete understanding of the control circuitry, and the manner in which heat is applied to the casing by the present embodiment, reference is made to the wiring diagram shown in FIG. 2 of the drawing. The unit is energized through a main on/-off switch 111, room therostat 112 and a selector switch 114 which selects the operation of the unit on either the heating or cooling cycle. Switch 114 includes a cooling switch 116 and a heating switch 118 by which the cooling or heating cycle is selected. Room thermostat 112 includes a switch 120 that is movable either between a cooling contact 122, or a heating contact 124. In the normal operation of the unit in either the heating or cooling cycle, operation of the compressor is from line L1 through switches 111, 112, 114 and through a defrost control apparatus 126, line 130 to compressor 52 and to line L2. Operation of the evaporator Fan 54 from switch 114 is through the evaporator frost sensing thermostat 132. The outdoor frost sensing thermostat 132 includes a temperature responsive switch 134 movable between a normally closed contact 136 and a contact 138. A circuit is completed through contact 138 only when frost is sensed on the evaporator while it is subjected to outdoor ambient temperatures during operation of the unit in the heating mode.

The sensing of frost on the evaporator 48 by evaporator thermostat 132 causes switch member 134 to engage contact 138 which completes a circuit to a defrost relay 141 of the defrost control apparatus 126. The defrost relay 141 includes a first relay switch means 142 movable relative to its contact 144 for energizing the heater 140 during the defrost operation, as mentioned above, and a second relay switch means 146 movable between a normally closed contact 148 to provide a circuit through line 130 for operation of the compressor during normal operation in either the cooling or heating cycle and a contact 150 which completes a circuit from switch 114 through a heater 152 in series with the compressor 52 to line L2.

The resistance of heater 152 is such that the compressor motor in a 120V. potential sees only 30V. This arrangement of providing a resistor in series with the compressor effectively passes current through the compressor motor in a stalled mode which causes generation of heat that is sufficient to raise and maintain the temperature of the gaseous refrigerant in the casing at approximately 150° F.

As noted above, in most outdoor ambient conditions, the normal heat generated by the already warm refrigerant in the condenser together with the added heat of heater 140 and that of the relatively warm compressor components is sufficient to provide an effective gravity defrost system during a wide range of outdoor ambient conditions. However, in some extreme ambient conditions, the defrosting process may be prolonged to the extent that the refrigerant might cool to a point where it is ineffective to complete the defrosting. By providing means for heating the refrigerant in the compressor casing, the temperature of the refrigerant will be maintained at a temperature that will insure defrosting during all outdoor ambient conditions.

The heater 140 is normally energized through relay switch 142 during each defrost cycle as shown in FIG. 2. Accordingly, in an alternative circuit control, heater 140 may be arranged through the relay switch to be in series with motor 55 and heater 152 may be eliminated. The heater 140 in this instance would still function as the air conditioner unit heater, while effectively passing current through the compressor motor in a stalled mode to generate the heat necessary to maintaifn the refrigerant at the selected temperature.

The foregoing is a description of the preferred embodiment of the apparatus of the invention and it should be understood that variations may be made thereto without departing from the true spirit of the invention as defined in the appended claims.

What is claimed is:

1. A refrigeration system of the type having a refrigerant capable of boiling under relatively low pressure to absorb heat and condensing under relatively high pressure to expel heat comprising:

a hermetic casing motor, including a compressor driven by said motor for compressing a refrigerant fluid in gaseous phase having an outlet port and an inlet port;

a condenser having a first opening in the upper portion and a second opening in the lower portion thereof;

a discharge conduit connecting said condenser first opening to said compressor outlet;

an evaporator arranged above said condenser and said compressor having a first opening in the upper portion and a second opening in the lower portion thereof;

a liquid conduit connecting the second openings of said condenser and said evaporator;

a suction conduit connecting said evaporator first opening to said compressor inlet;

a flow control means in said liquid conduit;

defrost means including a first defrost flow passage connected parallel with said liquid conduit between said second openings of said evaporator and said condenser, and a second defrost flow passage connecting said first opening of said evaporator and said compressor casing to provide a series flow refrigerant path in series through said discharge conduit, compressor casing, and said second defrost flow passage, a first valve in said first defrost flow passage and a second valve in said second defrost flow passage;

said first and second valves being operable to a closed position when a refrigerant pressure differential is present in said system and being operable to an open position when said pressure differential is bled down through said flow control means after said compressor operation terminates, so that a nonrestrictive refrigerant defrost flow path circuit is established bypassing said flow control means through said first defrost flow passage between the second opening in the lower portions of said condenser and said evaporator and through said second defrost flow passage between said first openings of said condenser and evaporator through the compressor casing, thereby allowing liquid refrigerant when present in the lower portion of said evaporator to flow through said first defrost flow passage into the lower portion of said condenser, while the warmer gasous refrigerant will flow through said second defrost flow passage from the condenser forst opening in the upper portion of said condenser through the compressor casing into the evaporator first opening in the upper portion of said evaporator to raise the temperature of said evaporator and melt frost when present;

control means including resistance means for raising the temperature of refrigerant in said compressor casing to a predetermined value to insure that the refrigerant flowing through the compressor casing between the first opening of said condenser and said evaporator is maintained at a predetermined temperature independent of ambient temperature conditions.

2. The refrigeration system recited in claim 1 wherein said control means further includes a frost sensing means, switch means operable by said frost sensing means, said resistance means being energized by said switch means in series with said compressor motor for passing a current through said motor in a stalled motor mode to cause a generation of heat by said stalled motor sufficient to raise the temperature of gaseous refrigerant in said casing to a predetermined level.

3. The refrigeration system recited in claim 1 wherein said control means further includes a frost switching means operable by said frost sensing means, said frost switching means includes a switch means operable from a first position completing a circuit for energizing said compressor during normal operation of said refrigeration system to a second position for completing a circuit through said resistance means in series with said compressor motor for passing a current through said motor in a stalled motor mode to cause a generation of heat by said stalled motor sufficient to raise the temperature of gaseous refrigerant in said casing to a predetermined level.

4. An air conditioning apparatus for conditioning air in an enclosure having a wall opening comprising:

a housing having openings on opposite sides thereof adapted to be positioned in said wall opening with the opening on one side of said housing facing the outdoors and the opening on the other side of said housing facing said enclosure;

a central chamber defined by spaced partition means dividing said housing into an evaporator compartment and a condenser compartment;

a fan shroud partition means in each of said compartments substantially dividing said compartments into inlet and outlet sections, each of said sections having an opening in both the indoor and outdoor facing side of said housing; a fan within each of said shrouds for circulating air through each of said compartments in a direction from said inlet section to said outlet section;

a first damper slidably arranged in the indoor facing side of said housing being associated with the indoor facing openings of said compartments; a second damper slidably arranged in the outdoor facing side of said housing being associated with the outdoor facing opening of said compartments;

a refrigeration system of the type having a refrigerant capable of boiling under relatively low pressure to absorb heat and condensing under relatively high pressure to expel heat including:

a hermetic casing motor, including a compressor driven by said motor for compressing a refrigerant fluid in gaseous phase having an outlet port and an inlet port;

a condenser having a first opening in the upper portion and a second opening in the lower portion thereof;

a discharge conduit connecting said condenser first opening to said compressor outlet;

an evaporator arranged above said condenser and said compressor having a first opening in the upper portion and a second opening in the lower portion thereof;

a liquid conduit connecting the second openings of said condenser and said evaporator;

a suction conduit connecting said evaporator first opening to said compressor inlet;

a flow control means in said liquid conduit;

defrost means including a first defrost flow passage connected parallel with said liquid conduit between said second openings of said evaporator and said condenser, and a second defrost flow passage connecting said first opening of said evaporator and said compressor casing to provide a series flow refrigerant path through said discharge conduit, compressor casing, and said second defrost flow passage, a first valve in said first defrost flow passage and a second valve in said second defrost flow passage;

said first and second valves being operable to a closed position when a refrigerant pressure differential is present in said system and being operable to an open position when said pressure differential is bled down through said flow control means after said compressor operation terminates, so that a nonrestrictive refrigerant defrost flow path circuit is established bypassing said flow control means through said first defrost flow passage between the second opening in the lower portions of said condenser and said evaporator and through said second defrost flow passage between said first openings of said condenser and evaporator through the compressor casing, thereby allowing liquid refrigerant when present in the lower portion of said evaporator to flow through said first defrost flow passage into the lower portion of said condenser, while the warmer gasous refrigerant will flow through said second defrost flow passage from the condenser first opening in the upper portion of said condenser through the compressor casing into the evaporator first opening in the upper portion of said evaporator to raise the temperature of said evaporator and melt frost when present;

control means including resistance means for raising the temperature of refrigerant in said compressor casing to a predetermined value to insure that the refrigerant flowing through the compressor casing between the first opening of said condenser and said evaporator is maintained at a predetermined temperature independent of ambient temperature conditions.

5. The refrigeration system recited in claim 4 wherein said control means further includes a frost sensing means, switch means operable by said frost sensing means, said resistance means being energized by said switch means in series with said compressor motor for passing a current through said motor in a stalled motor mode to cause a generation of heat by said installed motor sufficient to raise the temperature of gaseous refrigerant in said casing to a predetermined level.

6. The refrigeration system recited in claim 4 wherein said control means further includes a frost switching means operable by said frost sensing means, said frost switching means includes a switch means operable from a first position completing a circuit for energizing said compressor during normal operation of said refrigeration system to a second position for completing a circuit through said resistance means in series with said compressor motor for passing a current through said motor in a stalled motor mode to cause a generation of heat by said stalled motor sufficient to raise the temperature of gaseous refrigerant in said casing to a predetermined level.

* * * * *